United States Patent [19]

Stern et al.

[11] 4,411,387

[45] Oct. 25, 1983

[54] MANUALLY-OPERATED SPRAY APPLICATOR

[76] Inventors: Donald J. Stern, 127 Underhill Rd.; Jon I. Allsop, 2317 N. Shore Rd., both of Bellingham, Wash. 98226

[21] Appl. No.: 371,276

[22] Filed: Apr. 23, 1982

[51] Int. Cl.[3] ..... B05B 7/24

[52] U.S. Cl. ..... 239/345; 239/349; 239/355; 239/371

[58] Field of Search ..... 239/355, 357, 369, 371, 239/341, 345, 346, 349; 222/631, 400.5

[56] References Cited

U.S. PATENT DOCUMENTS

| | | | |
|---|---|---|---|
| 1,809,073 | 6/1931 | Schylander | 239/341 |
| 2,305,269 | 12/1942 | Moreland | 239/371 X |
| 2,923,481 | 2/1960 | Pinke | 239/355 X |
| 3,788,526 | 1/1974 | Thornton | 222/631 |

FOREIGN PATENT DOCUMENTS

| | | | |
|---|---|---|---|
| 250831 | 9/1911 | Fed. Rep. of Germany | 239/345 |

*Primary Examiner*—John J. Love

*Attorney, Agent, or Firm*—Hughes, Barnard & Cassidy

[57] ABSTRACT

A manually-operated spray applicator for discharging a coating fluid is comprised of a receiving chamber having inlet and outlet ports for respectively admitting and discharging coating fluid under pressure developed by a jet of air issuing slightly upstream of the receiving chamber and created upon the manual stroke of an air-compression piston; a closed compression chamber isolated from the receiving chamber within which the airjet is developed; and a stroke-responsive sealing stem having a central airway with an air jet orifice in registration with the discharge area of the outlet port, which airway is in communication with the compression chamber; wherein the sealing stem is adjustably reciprocable along a line from a biased sealing position closing the outlet port at the beginning of a stroke on the piston, to a retracted position with the airjet removed to a preselected position slightly upstream of the outlet wherein the sealing stem returns to its sealing position prior to the completion of that stroke.

26 Claims, 13 Drawing Figures

MANUALLY-OPERATED SPRAY APPLICATOR

BACKGROUND OF THE INVENTION

1. Field of the Invention

The present invention relates, generally, to compression spray applicators for coating fluids and, more especially, to manually-operated spray applicators which may be used to apply surface coating of viscous fluids such as plaster or other texturizing materials.

2. Description of the Background Art

Compression sprayers are, of course, well known. Generally, a jet of compressed air is employed to pressurize a source of fluid which is propelled as the result of that pressure head, to entrain the fluid either directly or indirectly (e.g., venturi), or simply to propel the fluid by direct impingement on it.

U.S. Pat. No. 2,923,481 is generally representative of the overall configuration of a manually-operated compression sprayer used, for example, to apply household and garden spray solutions for controlling pests, deodorizing, or the like. While that patent is more particularly directed to a specific nozzle configuration within such a context, it exemplifies a construction where a closed compression chamber receives a pressurizing piston which, upon manual stroking, creates a pressure head responsible for propelling liquid housed within an associated reservoir. As the concept behind these household or garden sprayers is now quite notorious, further details in respect thereof are not warranted herein.

More to the direct point of the present invention, the principles behind the compressive spray application of fluids have been adapted for spray applicators designed expressly for the application of very viscous materials, such as plaster or viscous paint materials used to provide a "texurized" surface. However, when the focus shifts from relatively low viscosity fluids, such as a liquid deodorant or insecticide material, to the application of these more viscous surface coatings, the approaches heretofore proposed have generally centered upon spray applicators employing a source of pressurized air or other propellant gas. Only scant attention has been paid to designs for a manually-operated compression sprayer useful in this context. For example, U.S. Pat. No. 4,204,645 discloses a relatively conventional compression sprayer equipped with a special head permitting spray application of, inter alia, viscous fluids which might include plaster or the like.

By way of further general background, there is a particularly vexing problem associated with compression spray applicators and one exacerbated when dealing with those designated for the application of plaster or similar materials. When the spray procedure first begins, and oftentimes at its termination, there is a pronounced tendency for a surge of fluid vis-a-vis the propelling airjet. This results in a highly undesirable spattering (i.e., "dribbling") during those times when the applicator is operating under other than steady state conditions as the fluid is improperly or incompletely atomized or propelled by the airjet.

Turning directly to representative patents concerning structures for spray applicators which are designed to prevent or minimize this spattering, whether in the spraying of paint or more viscous materials such as plaster, U.S. Pat. No. 1,609,465 is illustrative. That device is a paint sprayer where paint is supplied to a "spray gun" through a first passageway and pressurized air through another. When an operating trigger is depressed, a portion of the pressurized air activates a diaphragm which is moved rearwardly against the force of a biasing spring maintaining a valve member in a normally closed position. As the valve member moves rearwardly it opens the spray nozzle so paint can flow from a reservoir into the airstream. The patentee provides for the issuance of propelling air through the nozzle for a very slight time period immediately prior to movement of the diaphragm and likewise causes the air to flow for a slight time period after the force on the diagram is released, to ensure that all of the paint is atomized and thereby prevent unwanted spattering. The diaphragm is pressure-responsive and is caused to open as the pressure builds once the trigger is pulled and then to close as the pressure drops once the trigger is released. Thus, since the rise and fall of pressure are not instantaneous, this approach relies on the slope of the pressure gradient at the beginning and ending of the spraying sequence to achieve the aforementioned objective.

A somewhat similar arrangement is disclosed in U.S. Pat. No. 1,332,554. The patentee there describes a spray gun useful for depositing paints or other coatings which might include a solid particulate in powder form. Like the structure described above, air is admitted to the device through one passageway and the fluid via another passageway. The two routes converge near the tip where fluid resides in an annular chamber surrounding a stem through which the pressurized air passes. The stem is initially sealed against the discharge port of that annular chamber and, upon activation of the device, is retracted out of engagement therewith so that the fluid may be propelled by the pressurized airjet. This occurs upon movement of an operating handle which causes the rear part of a piston to be exposed to atmospheric pressure whereby the pressure gradient causes the entire stem to retract in the manner noted above.

Conceptually similar approaches have been applied to the task of dispensing plaster or other viscous coatings from a spray gun. Illustrative of such devices are those disclosed in U.S. Pat. No. 2,801,880, No. 2,964,302, and No. 3,236,459. In each of those structures, the driving force for application of the plaster is compressed air which is admitted to the spray gun for the purpose of propelling plaster admitted from a container associated with the gun.

These prior art attempts to provide apparatus for the application of plaster or similar viscous coating fluids, centering upon adaptations of paint sprayers or the like which rely upon a source of compressed air for the driving force, leave much to be desired from the perspective of a "nonprofessional," such as an individual homeowner wishing to undertake his own home improvements. Not only is the gun applicator usually a fairly complicated and expensive device, one necessarily must have an air compressor to drive the gun thereby further increasing the cost. The capital expense of acquiring such a device for spray application of plaster or the like puts many of these applicators well beyond the financial reach of most individuals. Apart from costs, the use of a spray gun and associated compressor can complicate the coating procedure since these devices tend to be bulky; the reach is limited by the length of tubing between the compressor and spray gun; and the entire package must be moved from room to room throughout a building, sometimes at considerable inconvenience. Thus, the convenience of simply pulling a trigger on the spray gun applicator is paid for by the loss of portable mobility. Further along these lines, large spray apparatus of this type require a fairly lengthy period of personal familiarization in order to obtain satisfactory results which, from an individual homeowner's point of view, leads to at least two further problems—the first time the apparatus is used it may be found by many to be a somewhat intimidating experience due to the noise and power of the device and, by the time one becomes accustomed to, or familiar with, the device, the project prompting its use may well be completed.

It should also be appreciated that even "professionals" sometimes find the use of unweildy compressor/-spray gun apparatus very undesirable. Small jobs or small contractors' operations oftentimes do not justify, from either a convenience or economic perspective, the use of such devices.

Accordingly, the need exists to provide a spray applicator for spraying viscous fluid coatings such as plaster or other texturizing materials which is simple in construction and use and which nonetheless is durable and reliable. The need also exists to provide such a device at a reduced cost so that the same may be procured and used by individual home owners.

SUMMARY OF THE INVENTION

The present invention advantageously provides a simple yet highly efficient, automatic, manually-operated spray applicator which is capable of applying plaster or other viscous coating fluids in a virtually "foolproof" manner. The present invention is desirable for its ability to spray these types of materials without the need to suffer the unwanted spattering associated with prior devices, excepting those of very complicated design and associated high cost of procurement. Thus, the spray applicator of the present invention is particularly desirable for use by individual homeowners who do not wish the inconvenience of using those applicators requiring air compressors for operation.

These and other advantages of the present application are provided by a manually-operated spray applicator for discharging a coating fluid by propelling that fluid from an outlet port with an airjet issuing slightly upstream thereof, which airjet is created upon the manual stroke of a pressurizing piston. The applicator includes a receiving chamber wherein the coating fluid is preferably contained under substantially static pressure conditions. The receiving chamber has an inlet port for admitting a quantity of the coating fluid thereto, preferably from an associated reservoir or container secured to the top of the applicator and from which coating fluid flows by gravity into the chamber; which reservoir, in a highly preferred embodiment, also includes a handle grip means for holding the applicator during the manual stroking of the associated compression piston. The receiving chamber further includes an outlet port for discharging a spray of a portion of the coating fluid, which port has a sealing seat outwardly bounding a discharge area. A closed compression chamber, isolated from the receiving chamber, is comprised of sidewalls and opposing end walls which receive a manually-operated compression piston having a stroke length defined generally between the end walls. A stroke-responsive sealing stem is disposed interiorly of the receiving chamber and includes a sealing face at the distal end thereof for engagement with the seat on the outlet port and a central airway terminating at the distal end in an airjet orifice in registration with the discharge area of that port. The central airway provides communication between the compression chamber and the discharge port area so that pressure developed within the chamber upon manual stroking of the piston is transmitted to the latter. The sealing stem is adjustably reciprocable along a line passing through the discharge port and airjet orifice from a biased, sealing position wherein the sealing face is in engagement with the seat thereby preventing discharge of coating fluid, to a spray position wherein the stem is retracted to a preselected location slightly upstream of the discharge port, from which position the air jet propels the desired quantity of fluid. The sealing stem is initially disposed in the sealing position at the beginning of a manual stroke so that, at first, air flows through the central airway and out of the discharge port while the latter is sealed. During an intermediate portion of the stroke, the sealing stem is caused to retract to the spray position where fluid within the area between the discharge port and airjet orifice is propelled outwardly of the applicator. Near the final extent of a manual stroke on the piston, the sealing stem returns to the sealing position, closing the discharge port so that the last portion of each stroke emits only air. Thus, since each stroke begins with and ends with a discharge of air only, unwanted dribbling or spattering is minimized if not precluded altogether, yielding a virtually foolproof operation.

In a highly preferred form of the present invention, this intermittent spraying of fluid during a single stroke is achieved by providing a spray control chamber which includes a pressure-responsive control piston secured to the sealing stem. The spray control chamber is disposed to isolate the receiving chamber from the compression chamber, and communicates with the latter through a spray control airway. The spray control airway includes a first port disposed within the compression chamber at a predetermined distance along the stroke length of the compression piston and a second port for admitting pressurized air to the spray control chamber as the pressure head is built up upon depression of the compression piston. Thus, as the piston is forced along its stroke length, a pressure head is developed within the spray control chamber thereby creating a force in opposition to the biasing force sealing the stem against the discharge port. Once the force within the spray control chamber exceeds the biasing force, the spray control piston moves within the spray control chamber and retracts the stem to the spray position. As the compression piston proceeds along its path and passes the position of the first port, the pressure head within the spray control chamber is vented thereby allowing the sealing stem to return to its normally closed position under the influence of the biasing force. The depth of retraction of the stem is preferably regulated by adjustable stop means in operative engagement with the stem to alter the volume of discharged fluid. In another, and highly preferred, variant of the present invention, valving structure is included preclude withdrawal of coating fluid through the stem during a return stroke of the compression piston.

Other advantages of the present invention, and a fuller appreciation of its structure and mode of operation, will be gained upon a review of the following detailed description, taken in conjunction with the figures of drawing, wherein:

DETAILED DESCRIPTION OF THE INVENTION

The present invention relates, generally, to spray applicators and, more especially, to a hand-held, manually-operated spray applicator for a coating fluid such as plaster or a like viscous fluid used to provide surface texturing. Accordingly, the present invention will now be described with reference to certain preferred embodiments within the aforementioned context; although those skilled in the art will appreciate that such a description is meant to be illustrative only and should not be deemed limitative.

Figure 1:
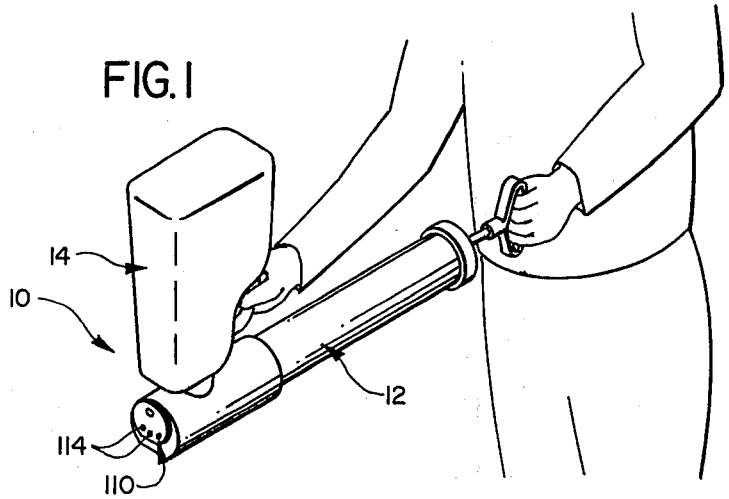
FIG. 1 is an isometric view showing the spray applicator of the present invention in use.

Turning to the figures of drawing, in all of which like parts are identified with life reference numerals, FIG. 1 shows a manually-operated applicator of the present invention, designated generally as 10, to be comprised of two basic components—an applicator body 12 and a reservoir 14 for containing material to be sprayed therefrom. The spray applicator body 12 itself includes three principal chambers: a receiving chamber 16 wherein fluid to be sprayed is contained; a closed compression chamber 18 where a pressure head is generated to produce a stream or jet of propelling air; and a spray control chamber 20 which regulates in a temporal sense the flow of propelling air vis-a-vis the fluid to be sprayed.

A stroke-responsive sealing stem means 22 is disposed within the applicator body 12, extending from the compression chamber 18 to the receiving chamber 16. Coating fluid 24 housed within the reservoir 14, when the same is inverted upon and associated with the applicator body 12 as shown in the figures of drawing, will fill the receiving chamber 16 by virtue of gravity feed and will be propelled therefrom by a jet pressurized air initially developed within the compression chamber 18. As noted above, an inherent and particularly vexing problem associated with the spray application of these types of fluid is unwanted spattering or dribbling of the, e.g., plaster at the beginning and near the end of each application procedure. This can arise at the beginning of an application where plaster near a discharge port is initially propelled by a surge of air which is applied more as an impulse force than a smooth propelling force, driving a greater quantity of fluid than desirable. Since the fluids of interest here are typically very viscous fluids, this effect is magnified. Near the end of an application cycle, since the propelling airsteam does not drop instantaneously from its steady state flow, there is likewise a tendency for spattering. These undesirable occurrences are overcome by the structure of the present invention whereby the sealing stem means 22 is made responsive to the application forces in a manner such that air is discharged from the spray applicator 10 for a slight time period at the beginning and end of each application cycle while the flow of coating fluid is precluded. Thus, fluid is discharged only during the interval of a spray cycle when the flow of propelling air is substantially under steady state conditions. And, this is achieved in the manually-operated applicator 10 without the need to resort to complicated structure, as outlined below.

Figure 3:
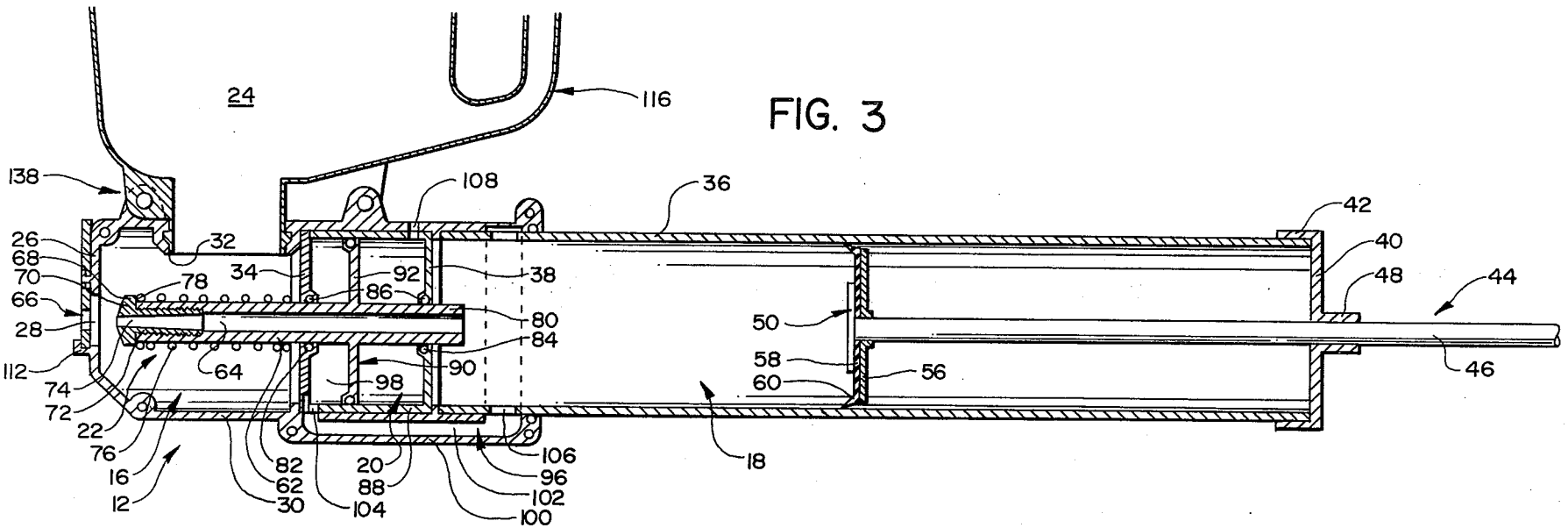
FIG. 3 is an enlarged, fragmentary sectional view of the applicator of FIG. 2, showing the compression piston intermediate the length of its stroke.

The receiving chamber 16 is comprised generally of a front wall 26 in which a discharge port 28, best viewed in FIG. 3, is formed preferably as a generally circular aperture, and a sidewall structure 30 having a recessed inlet port 32 formed in the top portion thereof for communication with the reservoir 14 which houses the fluid 24 to be sprayed. A rear end wall 34 completes the overall contour of the receiving chamber 16 for containing the coating fluid in a condition whereby the same may be spray discharged in a controlled manner.

The closed compression chamber 18 is physically isolated from the receiving chamber 16. The compression chamber 18 is defined generally by a sidewall 36, an inner end wall 38 and an outer end wall cap 40. The cap 40 includes an outer, circumferential sidewall 42 for engagement with the sidewall 36 so that the cap may be removed to gain access to the chamber 18 and facilitate construction of the applicator.

A compression piston means, designated generally as 44, is received through the end wall cap 40 and projects into the compression chamber 18. The compression piston means 44 is comprised of a piston rod 46 which passes through a central, generally circular guide flange 48 extending outwardly from the cap 40; the rod 46 terminating at its distal end in piston head designated generally at 50 and at its proximal end in a handle 52 used to manipulate the piston. In the preferred construction shown, the piston head 50 is of a generally conventional design, including an outer disc 54 secured to the end of piston rod 46 and an inner disc 56 borne upon the piston rod and sandwiching a piece of gasket material 58 in the form of a cup seal. The seal 58 is configured to mate with the internal geometry of the compression chamber 18, and includes a sealing lip 60 where it rides along the inner face of the sidewall 36. Accordingly, as the compression piston means 44 is depressed by application of a stroke force on handle 52, moving through its stroke length defined generally between the outer end wall cap 40 and inner end wall 38, a pressure head of compressed air will be developed forward of the piston head 50 within the compression chamber 18.

The sealing stem 22 passes through the receiving chamber 16 into the compression chamber 18 generally along a longitudinal axis through the applicator body 12. The sealing stem 22 is comprised of a shank 62, preferably a tubular shank having a central airway 64 through which an airjet may pass in response to a pressure head developed within the compression chamber 18. An airjet orifice, designated generally as 66, is disposed at the distal end of the shank 62. As shown in the figures of drawing, the airjet orifice is formed in an insert 68 secured to the end of the shank 62 in any convenient way. The insert 68 is illustrated in this preferred embodiment to have an enlarged tip 70 extending from a threaded stem 72 which mates with internal threads in the airway 64; albeit, depending upon the material from which the components are made, the insert might be secured adhesively or by another bonding technique. It is generally preferred, however, to form the distal end of the sealing stem 22 as two separate components so that the air passageway 64 may be constricted to a smaller airjet orifice diameter, as shown at 74, to increase the velocity of propelling air issuing from the stem.

Figure 2:
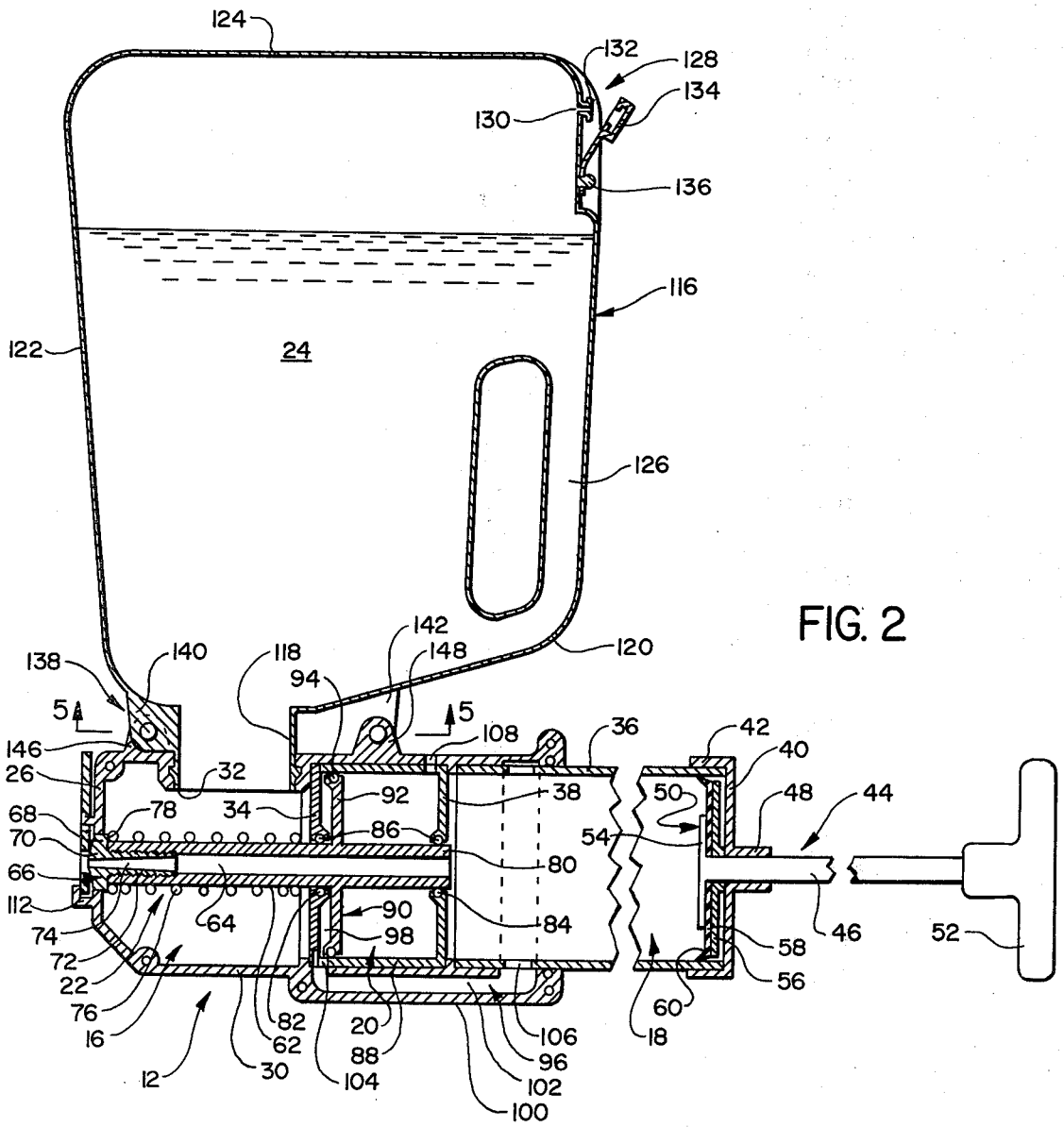
FIG. 2 is a side sectional view of the spray applicator of the present invention, where the compression piston is at the beginning of its stroke.

Regardless of the manner of construction of the stem 22, the same is preferably biased into sealing engagement with the discharge port 28 to prevent discharge of fluid 24 when the applicator is in the condition illustrated in FIG. 2, that being in advance of any force applied to the compression piston means 44. For this purpose, biasing means 76 are included to urge the insert 68 into sealing engagement with the discharge port 28. In the preferred embodiment shown, the biasing means is comprised of a coil spring disposed between a lip 78 on the enlarged insert 68 and the end wall 34 of the receiving chamber 16. Although other types of biasing means might be employed to urge the sealing stem 22 into a normally closed position against the discharge orifice, the coil spring is found most convenient and reliable in extended use.

The shank 62 of sealing stem 22 passes through both the end wall 34 of the receiving chamber 16 and end wall 38 of the compression chamber 18 so that the proximal end of the stem, designated 80, projects slightly into the latter chamber. Both of the end wall members 34 and 38 are provided with central apertures, 82 and 84 respectively, for receiving the shank 62 and guiding the same during its reciprocating path, as described below. Each of the apertures 82 and 84 is preferably provided with a seal, such as an O-ring seal 86, to maintain pressure integrity of the applicator during use.

The spray control chamber 20 physically isolates the receiving chamber 16 from the compression chamber 18. The control chamber 20 is defined generally between side walls 88 and the end walls 34 and 38 associated with the other chambers. The control chamber 20 receives a spray control piston means, designated generally 90, in operative engagement with the shank 62. As shown in the figures of drawing, the spray control piston means 90 is comprised of a generally circular web 92 secured directly to the shank 62 intermediate the length thereof, and terminating in a circumferential seal 94 where the web mates with the sidewalls 88.

A spray control airway, designated generally as 96, provides communication between the compression chamber 18 and a control piston head area 98 defined between end wall 34 and web 92. The airway 96 is preferably formed in an enlarged wall area 100 of the sidewalls 88, to define an airway channel 102 having a first port 104 leading into the piston head area 98 and a second, spray control port communicating with the sidewall 36 in the compression chamber 18; the position of this control port being spaced from the end wall 38 by a preselected distance corresponding to a location along the stroke length of the compression piston means 44 at which it is desired to return the sealing stem to its sealing position as described immediately below. A vent 108 is included rearwardly of the piston 90 through the sidewall of the control chamber to permit the piston to reciprocate therein.

Figure 4:
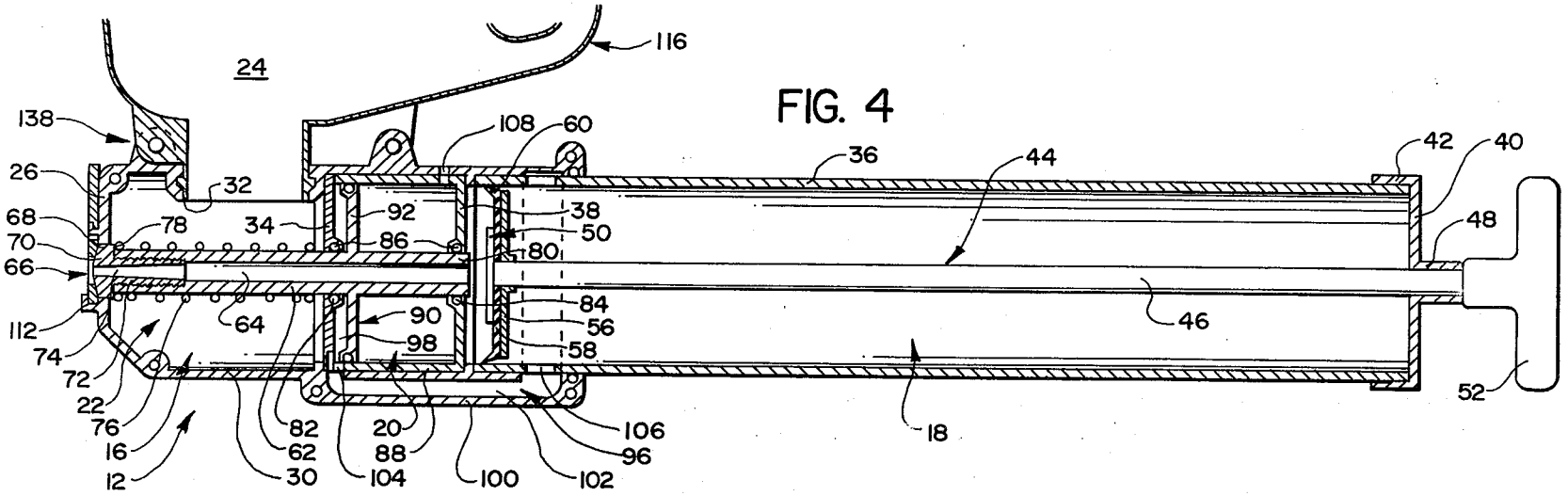
FIG. 4 is a view similar to FIG. 3, but showing the compression piston at the end of its stroke.

FIGS. 2, 3 and 4 show, progressively, a single stroke of the compression piston means 44 and the response of the sealing stem 22 thereto. FIG. 2 shows the initial position of the applicator 10 before a spray discharge cycle, where the piston head 50 is withdrawn to its rearward-most position and prior to a depression thereof along its stroke length. At this time, the biasing force provided by spring 76 maintains the sealing stem in sealing engagement with the discharge port 28 thereby preventing discharge of coating fluid. As the compression piston means 44 is depressed, and begins its stroke within the compression chamber 18, a pressure head will be developed therein. This pressure head is manifested in two ways. Initially, the pressure differential existing between the proximal and distal ends of the airway 64 will result in an airjet issuing from the constricted orifice 74. Concomitantly, the pressure head in compression chamber 18 will cause the development of a corresponding pressure head within the piston head area 98, thereby exerting a rearward force on the control piston 90. The force exerted on the piston 90 will increase fairly rapidly and ultimately exceed the opposing force of biasing spring 76, causing the sealing stem 22 to retract as the piston web 92 is forced rearwardly within the control chamber 20, as illustrated in FIG. 3. The movement of the control piston 90 will be delayed somewhat from the initiation of the airjet through airway 64 due to, amongst other factors, the friction between fluid in the receiving chamber 16 and the shank 62, the friction of the piston 90 within the control chamber 20, and the need to overcome the threshold force applied by biasing spring 76. Also, by controlling the venting of air on the back side of web 92, through the vent 108, the pressure necessary to move the control piston may be varied or adjustably regulated to respond faster or slower to the initial pressure head developed in compression chamber 18. Accordingly, the airjet will initially pass through the airjet orifice prior to any discharge of coating fluid as the stem initially remains in its sealing position.

When the biasing force has been overcome and the sealing stem has retracted to the spray position shown in FIG. 3, continued depression of the compression piston means 44 along the stroke length will maintain the pressure head within the control chamber and likewise maintain the sealing stem in its spray position. At this time, fluid 24 disposed intermediate the discharge port 28 and airjet orifice 66 will be propelled outwardly of the former by the force of the airstream. Continued depression of the compression piston means maintains a high pressure airjet which is substantially at a steady state flow condition and which, in turn, causes a uniform spray of coating fluid.

The steady state flow of coating fluid continues as the compression piston means continues along its stroke length until the piston head 50 passes beyond the physical location of the spray control port 106, as shown in FIG. 4. Immediately, once the piston head 50 passes the control port, the pressure causing the force on the control piston 90 to exceed that of the biasing spring is vented behind the moving piston 50, and the biasing force on the sealing stem returns the same to its sealing engagement with the discharge port 28. By proper location of the control port 106 along the stroke length of the compression piston means 44, the time at which sealing occurs vis-a-vis the termination of stroke length can be regulated. In any event, the discharge port is now sealed against egress of coating fluid prior to the termination of the spraying stroke, so that air continues to pass through the airjet orifice 66 until the piston means 44 reaches it full stroke depth within the compression chamber 18. Thus, it can be seen that the spray discharge of fluid occurs only during the intermediate portion of a given stroke on the compression piston, thereby insuring a substantially steady state airflow through the airjet orifice at times during which the spraying is to occur. In turn, this minimizes, or prevents altogether, the unwanted spattering which oftentimes occurs during gradients or variations in the airflow at the beginning and near the end of each application cycle.

The spray pattern of emitted fluid is further controlled by a variable spray aperture plate, designated generally as 110, fitted outwardly proximate the front wall 26 of the receiving chamber 16. The plate 110 is preferably in rotational engagement with the front wall within a guide 112 in order to present one of a number of spray apertures 114 as viewed, for example, in FIG. 1. Each aperture will have a different diameter and a selected one may be rotated into registration with the discharge port 28 in order to regulate the spray angle of fluid during the application process.

The reservoir 14 preferably forms an integral part of the apparatus 10. As shown in the figures of drawing, reservoir 14 is comprised of an inverted container 116 having a neck 118 disposed for engagement within the inlet port 32. The neck 118 merges outwardly to a top wall 120 (in the normal storage position), sidewalls 122 and a bottom wall 124. Fluid 24 to be dispensed may be prepackaged in the container 116 or the user may charge this fluid to the container.

Preferably, the container 116 is molded from a polymeric material to facilitate the formation of a handle grip means 126 as best viewed in FIG. 2. To insure good flow of liquid from the container, the same also preferably includes a vent means designated generally as 128, located along sidewall 122 near its juncture with wall 124. In the preferred embodiment shown in FIG. 2, the vent means 128 includes a vent aperture 130 having an outwardly directed locking lip 132 for engagement with a cap 134 configured to mate and lock on the lip. When the container 116 is fabricated from a polymeric material, an integral hinge 136 is easily and preferably included so that the guard cap 134 remains associated with the container.

Figure 5:
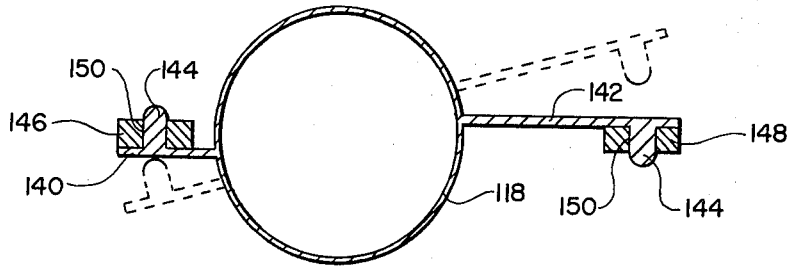
FIG. 5 is a sectional view taken substantially along the line 5—5 of FIG. 2.

As it is envisioned that the user will grasp the grip 126 in one hand and the handle 52 in the other during the spray application of fluid, it is important that the container 116 be secured firmly to the applicator body 12. For this purpose, a reservoir locking means 138, best viewed in FIGS. 2 and 5, is provided. Locking means 138 is comprised of forward and rearward upstanding webs 140 and 142 extending between the neck 118 and wall 120. Each web includes a locking pin 144, best viewed in FIG. 5, generally normal to the plane of the web, but extending in opposite directions therefrom. Forward and rearward, upstanding eyelets 146 and 148, respectively, are formed in the sidewall structure of the applicator body 12. Each eyelet includes a central aperture 150 having an inner diameter approximately equal to and preferably slightly less than the outer diameter of pin 144 in order that the latter may be received securely within the former. As is best visualized with reference to FIG. 5, the container 116, in its normally upright position, is fitted first within the inlet port area 32 with the webs rotated slightly as represented in phantom lines. Then, by simple rotation of the container with respecct to the body 12, the pins 144 will be guided into and received securely by the locking apertures 150. With the container thus secured to the spray applicator, it may then be inverted to the position shown in the figures of drawing, and is ready for use as depicted diagrammatically in FIG. 1.

FIGS. 6–9 illustrate an alternate embodiment of the spray applicator 10, wherein the device includes valve means for confining airflow through the central airway 64 substantially to unidirectional flow from the proximal end 80 to the constricted orifice 74. Under many situations, the inclusion of such a valve will be desirable to guard against the inadvertent and undesirable withdrawal of coating fluid within the airway 64 on the return stroke of the air compression piston. Although the stem 22 is in sealing engagement with the discharge port 28 during the latter stages of a compression stroke, thereby discharging any coating fluid which might be forced into the orifice 74 as the stem returns to sealing engagement, the valving system is desirable to preclude airflow in the reverse direction through the airway during the return stroke of the compression piston.

This valve means for confining airflow through the central airway is comprised of a first check valve means, designated generally 152, in airflow communication with the central airway 64 and a return stroke valve means, designated generally as 154, in airflow communication across a modified piston head designated generally 156. The check valve means 152 is shown to be disposed internally of the stem 22 within the central airway 64. Valve means 152 is designed to permit airflow through the airway 64 only upon a compression stroke, precluding substantially any airflow through the airway during a return stroke while the return stroke valve permits venting to facilitate that stroke.

Figure 8:
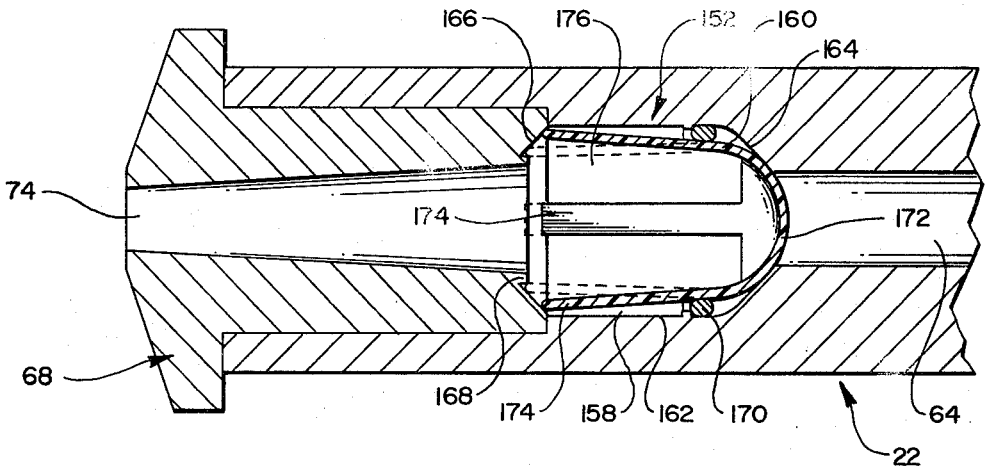
FIG. 8 is an enlarged sectional view of the stem showing an internal valve.

FIG. 8 illustrates the most preferred construction for the check valve 152, which serves to provide closure means for the airway 64 during a return stroke of the piston 156. As shown in that figure, the valve means 152 is comprised of a chamber 158 disposed intemediate the airway 64 and constricted orifice 74, receiving a valve spring 162 which is responsive to the pressure head developed within compression chamber 18 from a sealing position shown in full lines to a flow position shown in phantom lines. Chamber 158 includes a generally cylindrical central portion defined by sidewall 162, a curved end wall 164 on the upstream side which merges from the cylindrical wall 162 to the terminus of airway 64 and a tapered end wall 166 on the downstream side. A stop ring 168 is formed at the juncture intermediate the tapered wall 166 and orifice 74 in order to regulate the movement of the valve spring means 160, as described more fully below. The valve spring means 160 is comprised of a segmented, annular ring 170 which engages the sidewalls 162, a hemispherical sealing head 172 which engages the sidewall 164, and a plurality of biasing spring fingers 174 which engage the tapered end wall 166. Preferably, there are three biasing spring fingers 174, separated by slots 176, disposed equiangularly about the segmented ring 170 with the slots 176 formed to extend through the area of that ring to the hemispherical head 172 allowing the fingers to flex against the inner surface of the chamber 158.

The valve spring 160 is illustrated in FIG. 8 in a sealing position, which is the normal configuration due to the biasing force provided by spring fingers 174 against the tapered end face 166. This biasing force urges the hemispherical sealing head 172 into sealing engagement with the curved end wall 164, thereby closing the airway 64. When the piston means 156 is depressed within the compression chamber 18, a pressure head is developed and transmitted to the upstream side of the valve spring 160, the downstream side being at atmospheric pressure. At that time, the pressure head acting on the hemispherical head 172 urges the valve spring downstream; the segmented annular ring 170 moving initially in engagement with the cylindrical sidewall 162 and the tips of the spring fingers 174 moving along the tapered face 166, thus being radially compressed. The stop ring 168 regulates the gross movement of the valve spring 160 within the chamber by terminating travel of the spring fingers 174, halting the movement of the valve spring 160 as it assumes the flow position shown in phantom lines. In that flow position, air may be transmitted from the airway 64 across the curved face of the hemispherical sealing head 172, through the slots 176 and issue from the orifice 74. At the end of a compression stroke, the resiliency of the spring fingers 174 will cause the tips thereof to ride upwardly along the tapered wall 166, tending to return the hemispherical head 172 to its sealing engagement with the curved end wall 164 of the chamber. As the piston 156 is returned, any tendency for reverse flow from the orifice 74 toward the airway 64 will only serve to seat the head 172 more firmly as that airflow will act on the inner, curved side thereof. Accordingly, the spring biasing force in combination with any tendency to create a negative pressure head on the upstream side of the valve spring 160 will cause a very positive seal thereby preventing the inadvertent and unwanted withdrawal of any coating fluid internally of stem 22.

The action of check valve means 152 should be closely coordinated with that of the control members which dictate the reciprocable movement of the stem 22, in order to achieve the goal of maintaining sealing engagement of the stem with the discharge port at the beginning and ending of each compression stroke. In other words, the biasing force provided by the spring fingers 174 needs to be coordinated with the biasing force on the stem 22 so that the valve 152 opens in advance of initial retraction of the stem during a spraying sequence. The preferred manner for attaining this cooperation is by fabricating the spring member 160 from a polymeric material, such as that sold under the tradename "DELRIN" and dimensioning the spring fingers to provide the desired amount of spring force. Other ways to meet this requirement will also occur to those skilled in the art.

Since the valve means 152 seals the passageway 64 of the reciprocable stem, venting of the compression chamber forward of the piston during the return stroke is required. The modified piston head 156 thus includes a return stroke check valve 154 permitting venting air to flow across the piston head during the return stroke, as shown in FIGS. 7 and 9.

The piston head 156 is comprised of an inner piston disc means 178 secured to the end of the piston rod 46 and a second piston disc 180 disposed in spaced, generally parallel relationship as respects disc 178. The spacing between the two discs 178 and 180 yields a gap 182 within which is received a cup seal member 184. The cup seal, as is conventional, includes a peripheral sealing lip 186 for engagement with the sidewalls 36 of the compression chamber in order to establish a pressure head forward of the piston head as the same depressed on a compression stroke. The cup seal is received in association with the discs on rod 46 through a central aperture in the former, designated as 188. The aperture 188 cooperates with venting apertures 190 in the inner disc 178, as described more fully below.

Figure 6:
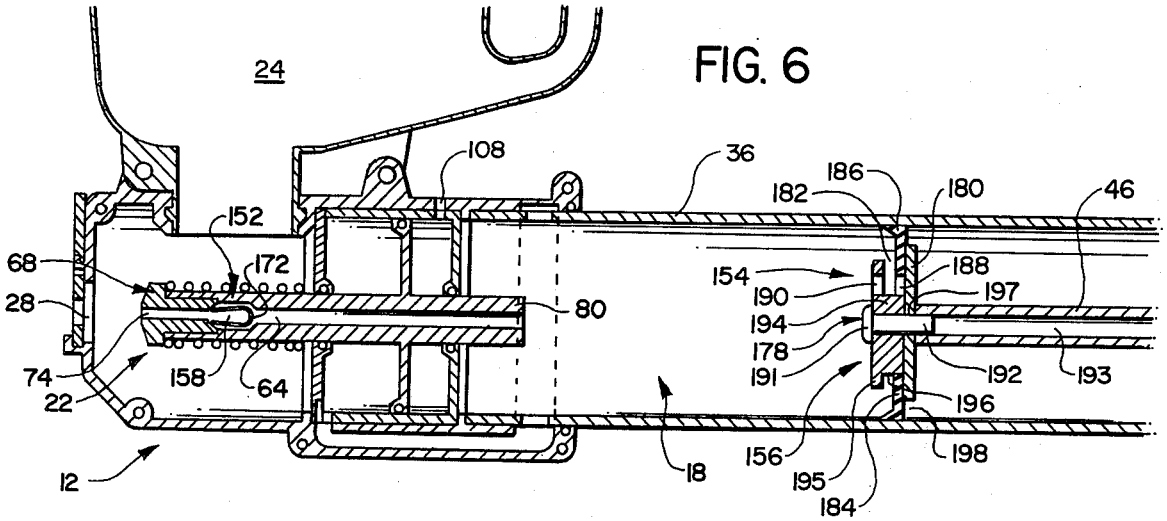
FIG. 6 is a side sectional view of a spray applicator in accordance with a preferred embodiment of the present invention showing valving structure to prevent withdrawal of coating fluid on a return stroke of the compression piston, wherein the compression piston is on its compression stroke.
Figure 7:
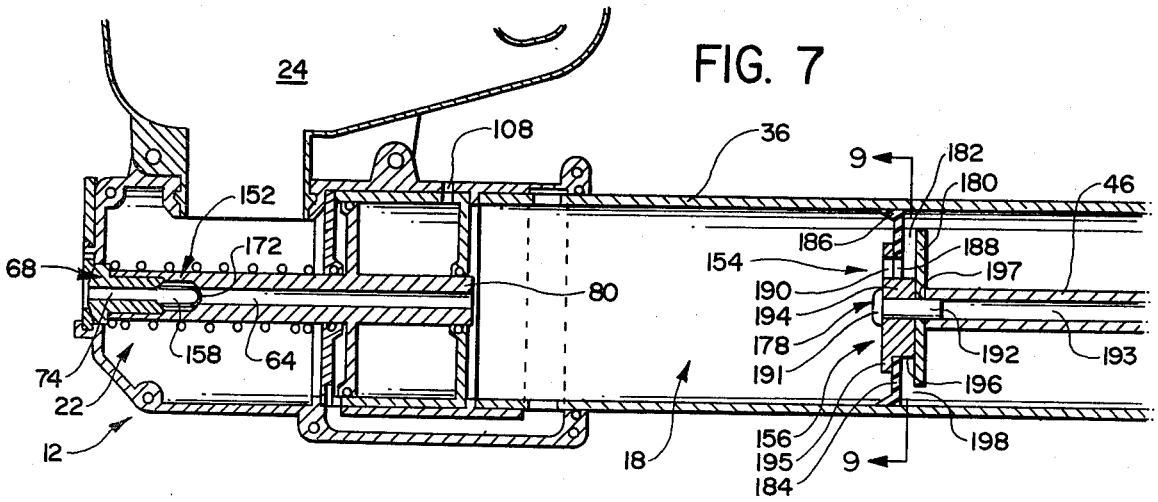
FIG. 7 is a side sectional view of the spray applicator of FIG. 6, but showing the compression piston on its return stroke.
Figure 9:
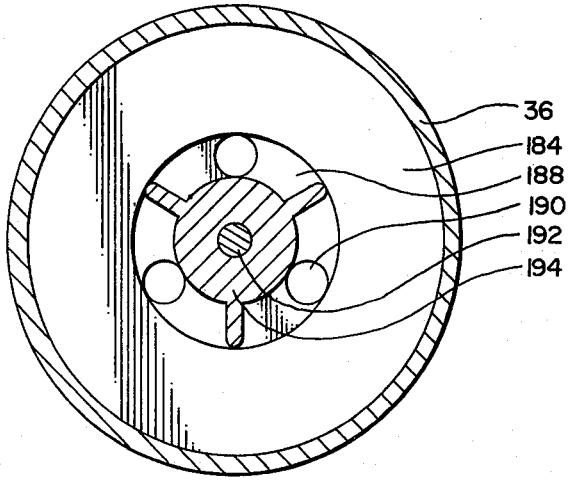
FIG. 9 is a sectional view taken substantially along the line 9—9 of FIG. 7.

In the preferred embodiment shown in FIGS. 6, 7 and 9, the piston disc 178 is designed in the form of a pin-type member having a head 191 and a shank 192 which projects into a hollow stem or passage 193 in the piston rod 46. A block or spacer 194 is disposed intermediate the head 191 of the pin and the piston disc 180. The spacer 194 includes a generally circumferential flange 195 defining an inner stepped face 196, the dimension of which corresponds to the width of gap 182. In this preferred structural embodiment, both the block 194 and the disc 180 include a central, fixture aperture, 196 and 197 respectively, having a diameter approximately equal to that of the shank 192. Accordingly, when the pin is inserted with the shank received in the passageway 193, secured there by either a very close interference fit or by a bonding technique, the disc 180 will be sandwiched between the block 194 and the end of piston rod 46 and maintained securely in place.

In order to provide venting action, the cup seal and cooperating piston discs are dimensioned in a preferred manner. As can be seen in the figures of drawing, each of the piston discs 178 and 180 has a transverse dimension less than that of the interior of compression chamber 36. The inner disc 178 has a dimension somewhat less than that of the disk 180, this latter disc serving as a backing for the cup seal 184 during the compression stroke. Accordingly, only a slight lateral gap, designated 198, exists between the sidewalls 36 and the circumferential edge of the disc 180; that gap being sized to permit airflow about the periphery of the outer disc on a return stroke of the piston head 156. The gap 182 between these two piston discs is somewhat greater than the thickness of the cup seal 184 by virtue of the interposed block or spacer 194, to yield a loose fit of the seal on the piston rod 46 in the longitudinal direction so that the seal may move somewhat longitudinally between the inner faces of the two opposing discs 178 and 180. Likewise, the aperture 188 in the cup seal is oversized as respects the diameter of piston rod 46. The oversized dimension of aperture 188 need be only sufficient to permit airflow between the outer surface of the rod 46 and the web of the seal 184, and should in all cases by substantially less than the transverse dimension of outer disc 178 since that member must pull the cup seal on the return stroke of the piston. The airflow path for the return stroke check valve 154 is completed through the venting apertures 190 formed in the disc 178.

During the compression stroke on piston head 156, the cup seal 184 is supported against the face of the piston disc 180 so that the lip 186 is in sealing engagement with the sidewalls 36. Accordingly, the compression stroke on the piston creates a pressure head within the compression chamber 18 resulting in airflow through the stem 22. Air flowing through the airway 64 of the stem 22 moves the check valve 152 permitting a flow path through the constricted orifice 74 outwardly of the device. On the return stroke, shown in FIG. 7, the airway 64 is sealed by check valve 152, preventing airflow from the distal to the proximal end of the stem and thereby precluding unwanted or inadvertent withdrawal of any coating fluid through the airway and into the compression chamber. The return stroke check valve means 154 permits this sealing engagement by venting air into the compression chamber across the piston head 156 during the return stroke. As can be seen in FIG. 7, the cup seal 184 tends to fold slightly forward as it is being withdrawn along the walls 36. Because of the gap 182 and oversized aperture 88, air may vent around the outer disc 80 through the gap 189 and that existing between the seal 184 and the outer disc and thence through the aperture 188 and cooperating venting apertures 190 in the inner piston disc 178. Accordingly, the combined valve means 152 and 154 confine airflow through the central airway 64 substantially to unidirectional flow from the proximal end to the distal end of the stem upon the compression/return stroke cycle of the piston 156. In turn, this prevents any fluid from being withdrawn through the airway 64 interiorly of the compression chamber 18 as might otherwise occur during a return stroke.

FIGS. 10–13 illustrate another and highly preferred embodiment of the spray applicator 10 of the present invention. In one aspect, the embodiment of FIGS. 10–13 differs from those shown above in that this form of the applicator includes spray adjustment means, designated generally as 200, for regulating the depth of retraction of the sealing stem 22 within the receiving chamber thus permitting adjustment of the discharge volume of coating fluid issuing from the device. The spray adjustment means 200 employs an adjustable stop means designated generally as 202, which is in operative communication with the stem 22 in order to regulate how far that stem will reside upstream of the discharge port 28 during a spraying cycle; three stages of adjustable retraction being shown in these figures. By controlling the point at which air issues from the orifice 74, relative to the volume of fluid between the orifice and discharge port 28, more or less fluid may be caused to be sprayed through the latter.

Adjustable stop means 202 is comprised generally of a stop ring 204 having a radially extending adjustment arm 206 with a length sufficient to project outwardly through an angled slot 208 formed in the sidewall 88. The ring 204 rides over the shank 62 of the stem 22, preferably in a relatively loose fitting engagement therewith, disposed between the spray control piston 90 and wall 38. In a preferred form, the ring 204 includes a central aperture having an inner diameter slightly greater than the outer diameter of shank 62 so that the stem 22 may reciprocate freely through the aperture in the ring.

Figure 11:
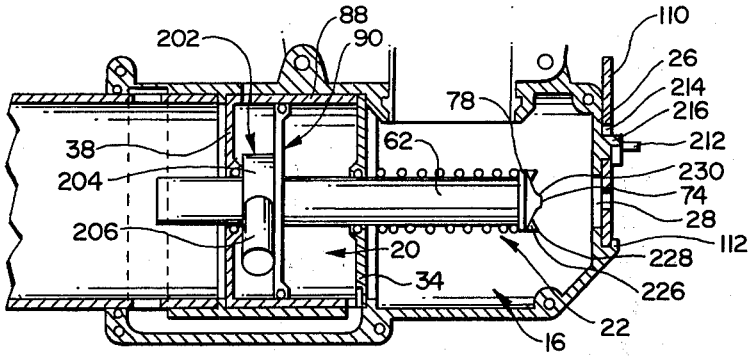
Figure 12:
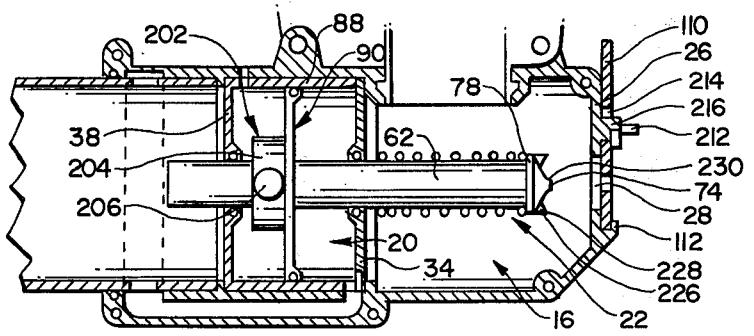
Figure 13:
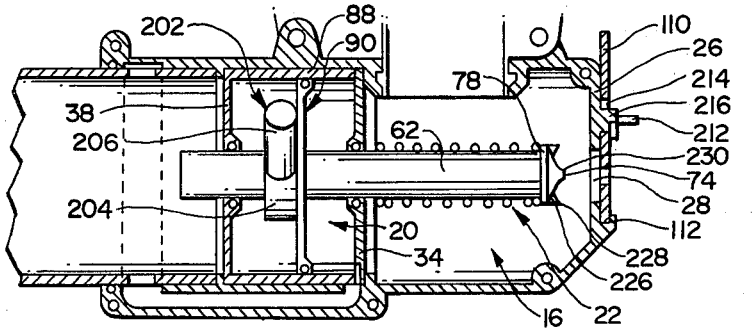

The slot 208 is disposed at an angle with respect to the longitudinal axis of the spray applicator 10. The width dimension of the slot 208 is only slightly greater than the thickness of arm 206 so that movement of the latter within the former will adjust the relative positioning of the ring 204 along the longitudinal axis, either forward or rearward as the arm is moved upward or downward (respectively) within slot 208. As best visualized with respect to the progression shown in FIGS. 11–13, when the arm 206 is at its lowermost position within the forwardly angled slot 208, ring 204 is disposed in its rearwardmost position within the control chamber 20; as the arm is moved to an intermediate location along angled slot 208, the associated ring moves slightly forward to assume the position shown in FIG. 12; while movement of the arm 206 to its uppermost position within slot 208 causes the ring to assume its forwardmost position within the control chamber 20, as shown in FIG. 13. Thus, as the control piston 90 is forced rearwardly upon the compression stroke of the piston, it will engage the face of ring 204 at a preselected location within the control chamber 20 governed by the placement of arm 206 within the angle slot 208. In turn, since the control piston 90 is in operative engagement with the reciprocable sealing stem 22, the latter's retraction travel within the receiving chamber will be regulated. With the stem 22 retracted to the furthest position, as shown in FIG. 11, a greater distance exists between the airjet orifice 74 through which the propelling airjet issues and the discharge port 28. In turn, this provides a greater volume of coating fluid 24 within the propelling airjet path, and a greater quantity of coating fluid is thereby sprayed in this configuration than is the case, for example, in FIG. 13. There, the sealing stem is retracted the least distance within the receiving chamber 16 and a lesser volume of coating fluid is within the propelling airjet path. Accordingly, manipulation of the adjustable stop means provides for a variation in the volume of coating fluid to be discharged from the spray applicator 10. Further as respects this optional but highly preferable feature, it should be remarked that the slot 208 will serve the same function as vent 108 in the embodiment of, e.g., FIG. 2, permitting a venting of the spray control chamber 20 during reciprocation of the control piston means 90.

FIGS. 10–13 also illustrate a highly preferred structure for retaining the variable aperture plate 110. As noted generally above, the plate 110 is associated with the front face of the applicator and is rotatable within guide means 112 in order to present one of a number of differing sized spray apertures 114. In addition to the control of the volume of fluid sprayed from the applicator, as achieved by the spray adjustment means 200, the pattern of spray issuing from the applicator may be regulated from a wide to a narrow spray by selecting an appropriately sized spray aperture 114.

Figure 10:
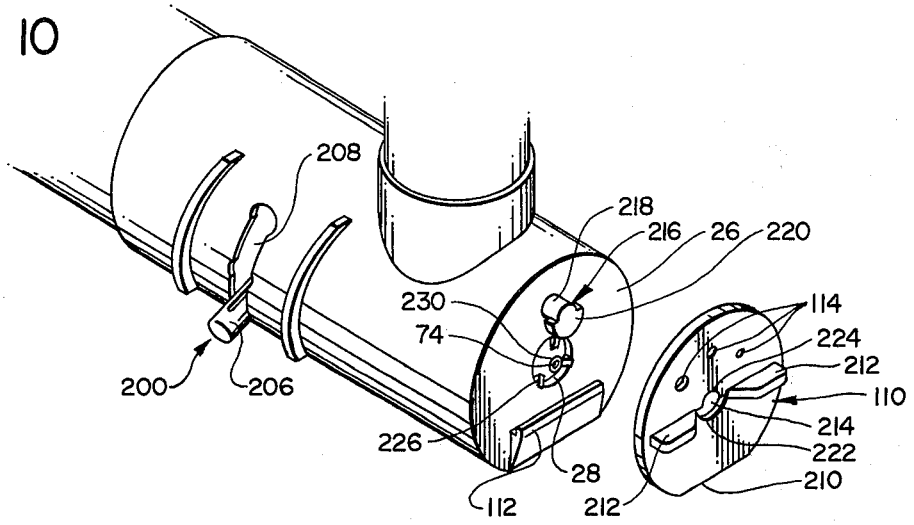
FIG. 10 is a fragmentary, exploded, isometric view of an alternate, preferred embodiment of a spray applicator in accordance with the present invention; and, FIGS. 11-13 are fragmentary side sectional views, with parts broken away, of the applicator of FIG. 10 showing three adjustable spray positions for application of coating fluid with the device.

As best viewed in FIG. 10, the plate 110 is a substantially circular disc having a flat 210 on the lower edge thereof. A pair of gripping webs 212 project outwardly of the face of the disc 110, serving as convenient places to grasp and rotate the same. A central fixture aperture 214 is provided for securing the disc to a cooperating fixture peg 216 projecting outwardly of the front wall 26. The fixture peg is shown to include a generally circular shank 218 terminating at a semicircular flange 220 for cooperation with the fixture aperture 214. That is, the aperture 214 is segmented into two semicircular portions, a first portion 222 having a radius only slightly greater than that of the flange 220 and a second portion 224 having a smaller radius corresponding to one only slightly greater than that of the shank 218. Accordingly, the plate 110 may be laid directly on the face 26, with the flat 210 passing over the guide 112 and with the peg 216 projecting through the aperture 214. Rotation of the disk 110 causes the outer periphery thereof to become engaged within the guide 112 while the enlarged radius portion 222 passes at least partially behind the flange 220; thereby securing the plate 210 at two points--on the peg 216 and within the guide 112.

In order to maintian the selected one of the apertures 114 in proper location vis-a-vis the discharge port, a type of detent cooperation is provided between the plate 110 and the tip of the sealing stem 22. In this preferred arrangement, the diameter of the lip 78 on the tip 70 is sized to be only slightly less than the diameter of the discharge port 28, so that the tip structure may project at least partially into that port. The front face of the tip 70 is formed to include a plurality of tabs 226, preferably three tabs spaced equiangularly about the tip, extending outwardly from the outer circumference and terminating slightly behind the extreme end of the discharge orifice. As best viewed in FIG. 11, each tab 226 is formed with a slightly reentrant portion so that each terminates at a relatively sharp tip 228. The taps 226 serve to locate the sealing stem within the discharge port 28, while the pointed ends or tips 228 provide a segmented generally circular line of engagement with the rear face of the plate 110. As the extreme end of the tip 70, identified 230 in FIGS. 11–13, projects slightly beyond the line of engagement, it will be biased within one of the selected apertures 114 during the spraying operation. As the plate 110 is rotated, for example to select a different aperture, the tip 230 will be urged backwardly against the biasing force of spring 76 until the next sucessive aperture 114 is located properly, at which time the spring will cause the tip 230 to move back into engagement with that aperture. Thus, the stem itself serves to provide a type of detent engagement between the discharge tip and the variable aperture plate 110, thereby maintaining positive alignment between the discharge spray and the selected spray aperture.

The front face 26 also incldues a slightly raised portion 230 immediately surrounding the outer periphery of the discharge port 28. This raised portion serves to create a slight space between the face 26 and the mating face of the aperture plate 110. Were this raised portion not to be included, the surface area between the rotatable plate and cooperating face 26 would be considerably greater and, were fluid to form a film between the two faces, removal of the plate from the devive would be more difficult.

In use, the spray applicator 10 of the present invention is both simple and reliable. Spattering is minimized if not altogether prevented by virtue of the stroke-responsive operation of sealing stem 22, where the sealing response is based upon the relative position of the compression piston along its stroke length. The material discharged from the applicator may be regulated in volume by the spray adjustment means 200 and in spray pattern in appropriate selection of a spray aperture 114. When the spray procedure is finished, the components are very easily cleaned with an appropriate solvent, such as water where plaster is the fluid being sprayed. The construction of the applicator allows for very easy disassembly for periodic cleaning and equally easy reassembly for use. And, all of this is achieved in a device of very simple yet rugged construction with an absolute minimum number of moving parts thereby contributing to reliability of the device.

While the invention has now been described with reference to certain preferred embodiments thereof, those skilled in the art will appreciate that various substitutions, modifications, omissions and changes may be made without departing from the spirit thereof. Accordingly, it is intended that the scope of the present invention be limited solely by that of the claims granted herein.

What is claimed is:

1. A manually-operated spray applicator for discharging a coating fluid residing therein by propelling said fluid as a spray from an outlet port with an airjet issuing slightly upstream thereof and created upon the manual stroke of an air-compression piston, said applicator comprising:

(a.) receiving chamber means wherein a coating fluid is contained, having an inlet port for admitting a quantity of said fluid thereto and an outlet port for discharging a portion thereof;

(b.) a closed compression chamber having sidewalls and opposed end walls, receiving a manually-operated air-compression piston having a stroke length defined generally between said end walls;

(c.) stroke-responsive sealing stem means having a central airway with an airjet orifice at the distal end thereof in registration with said outlet port and communicating at its proximal end with said compression chamber, said stem means being reciprocable in response to the location of said air-compression piston along the stroke length thereof, from a biased sealing position wherein said stem means is in sealing engagement with said outlet port to a spray discharge position wherein said stem is retracted and said airjet orifice is disposed within said receiving chamber slightly upstream of said outlet port; and, (d.) spray control means for reciprocating said stem means in response to the location of said air-compression piston along said stroke length, said spray control means first retracting said stem means to said spray discharge position and then returning said stem means to said sealing position intermediate the length of said stroke, whereby said stem means is in said sealing position at the beginning and end of each stroke of said air-compression piston.

2. The applicator of claim 1, wherein said spray control means is comprised of a spray control chamber including a spray control piston means in operative engagement with said stem means, whereby reciprocation of said control piston within said control chamber causes reciprocation of said stem means, and a spray control airway providing communication between said control chamber and said compression chamber through a spray control port located in said sidewall of said compression chamber at a preselected distance along said stroke length corresponding to the stroke-responsive return of said stem means near the end of said stroke; wherein depression of said air-compression piston creates a pressure head within said control chamber having a force in excess of the biasing force on said stem means thereby reciprocating said stem means to said spray discharge position and further wherein continued depression of said air-compression piston beyond said spray control port permits venting of said pressure head and return of said stem means to said sealing position prior to the end of said stroke.

3. The applicator of claim 2, wherein said receiving chamber is comprised of a front wall having an aperture therein defining said outlet port, a sidewall having an aperture therein defining said inlet port, and an end wall having a sealed aperture therein for receiving said stem means intermediate the length thereof and guiding said stem during reciprocation thereof.

4. The applicator of claim 3, wherein said stem means includes a hollow shank terminating at a radially enlarged distal end having a lip, said applicator further comprising biasing spring means disposed between said lip and said end wall of said receiving chamber for biasing said stem means into sealing engagement with said outlet port.

5. The applicator of claim 4, wherein said control chamber is comprised of a sidewall extension of said receiving chamber sidewall, a first end wall coincident with said end wall of said receiving chamber and a second end wall having a sealed aperture therein for receiving said stem means near the proximal end thereof and guiding said stem during reciprocation thereof.

6. The applicator of claim 5, wherein said control airway is disposed outwardly proximate the sidewall of said control chamber having a forward port for admitting air from said compression chamber to a head intermediate said first end wall and said control piston.

7. The applicator of claim 6, wherein said control piston is secured to said shank intermediate the length thereof.

8. The applicator of claim 7, wherein said compression chamber is comprised of a sidewall extension of said receiving and control chamber sidewalls, an inner end wall coincident with said second end wall of said control chamber and an outer end wall spaced therefrom by a distance equivalent to said stroke length, said outer end wall including an aperture receiving a piston rod having a piston head secured to its distal end disposed within said compression chamber and handle means secured to its proximal end.

9. The applicator of claim 2, further comprising spray adjustment means for controlling the volume and pattern of coating fluid discharged therefrom.

10. The applicator of claim 9, wherein said spray adjustment means comprises stem retraction control means for regulating the depth of retraction of said stem means within said receiving chamber.

11. The applicator of claim 10, wherein said stem retraction control means comprises a stop ring in adjustable, cooperative engagement with said stem means and lever means for positioning said stop ring at a preselected location corresponding to a desired depth of retraction of said stem means.

12. The applicator of claim 11, wherein said stop ring is disposed within said spray control chamber rearwardly of said control piston and is adjustable to a preselected location therein for butting engagement with said control piston to limit the depth of travel thereof.

13. The applicator of claim 12, wherein said stop ring includes a central stem aperture receiving said stem means in sliding engagement therewith and said lever means projects outwardly of said sidewall through a slot disposed at an angle with respect to the axis of said stem means whereby movement of said lever will move said stop ring forwardly or rearwardly within said spray control chamber.

14. A manually-operated spray applicator for discharging a coating fluid residing therein by propelling said fluid as a spray from an outlet port with an airjet issuing slightly upstream thereof and created upon the manual stroke of an air-compression piston, said applicator comprising:

(a.) receiving chamber means wherein a coating fluid is contained, having an inlet port for admitting a quantity of said fluid thereto and an outlet port for discharging a portion thereof;

(b.) a closed compression chamber, having sidewalls and opposed end walls, receiving a manually-operated air-compression piston having a stroke length defined generally between said end walls;

(c.) stroke-responsive sealing stem means having a central airway with an airjet orifice at the distal end thereof in registration with said outlet port and communicating at its proximal end with said compression chamber, said stem means being reciprocalbe in response to the location of said air-compression piston along the stroke length thereof, from a biased sealing position wherein said stem means is in sealing engagement with said outlet port to a spray discharge position wherein said stem is retracted and said airjet orifice is disposed within said receiving chamber slightly upstream of said outlet port; and, (d.) valve means for confining airflow through said central airway substantially to unidirectional airflow from said proximal end to said distal end upon a compression/return stroke cycle of said air-compression piston.

15. The applicator of claim 14, wherein said valve means comprises check valve means in series airflow communication with said central airway.

16. The applicator of claim 15, wherein said check valve means comprise chamber means disposed within said central airway having an upstream sealing face and a downstream biasing face and valve spring means received in said chamber, having a sealing element for sealing engagement with said upstream face and spring finger means disposed proximate the upstream side of said biasing face when said check valve means is in its sealing configuration and wherein said sealing element is urged downstream and said spring finger means are urged into biasing engagement with said biasing face when said check valve is in its flow configuration.

17. The applicator of claim 16, wherein said chamber means is in series flow relationship with said central airway and includes an intermediate, generally cylindrical chamber having a curved end wall merging to said airway at the upstream side, comprising said upstream sealing face, and a generally conical, tapered end wall at the downstream side, comprising said biasing face, said chamber further including check valve stop means on said tapered end wall for limiting the movement of said valve spring in said flow configuration.

18. The applicator of claim 17, wherein said valve spring means comprises a annular ring having a generally hemispherical end wall at the upstream side comprising said sealing element for engagement with said curved end wall of said chamber and a plurality of spring fingers disposed equiangularly about said annular ring and extending generally longitudinally within said cylindrical chamber to a location proximate the juncture thereof with said tapered end wall in said sealing configuration, and further wherein said hemispherical end wall is displaced downstream and said fingers are displaced downstream and are compressed radially inward in contact with said tapered end wall in said flow configuration.

19. The applicator of claims 15, 16, 17 or 18, further comprising return stroke valve means for venting said compression chamber upon the return stroke of said air-compression piston.

20. The applicator of claim 19, wherein said air-compression piston is comprised of first and second piston disc means disposed in spaced, generally parallel relationship and receiving therebetween resilient seal means for engagement with the sidewall of said compression chamber, wherein the transverse dimensions of said piston discs are each less than that of said seal means and the longitudinal spacing therebetween is greater than the thickness of said seal means, and further wherein said seal means includes a central, venting aperture and said first piston disc means includes at least one venting aperture, whereby said seal means is supported by said second disc means with said central venting aperture sealed thereby during a compression stroke and said seal means is supported by said first disc means with a venting route established through said venting apertures during a return stroke.

21. The applicator of claims 1, 2, 9 or 14, further comprising reservoir means for containing a supply of said fluid, secured to said receiving chamber in fluid communication with said inlet port.

22. The applicator of claim 21, wherein said reservoir means includes a closed container having a neck with an open end received in said inlet port and locking means for securing said container to said receiving chamber.

23. The applicator of claim 22, wherein said locking means is comprised of first and second web means integral with said container proximate said neck extending forwardly and rearwardly outward therefrom, and first and second pin means extending normal to said first and second web means, respectively, in opposite directions therefrom, and further wherein said applicator includes first and second upstanding eyelet means for receiving said first and second pin means, respectively.

24. The applicator of claim 22, wherein said reservoir means includes a rearwardly disposed handle grip means.

25. The applicator of claim 24, wherein said reservoir means includes vent means.

26. A manually-operated spray applicator for discharging a coating fluid residing therein by propelling said fluid as a spray from an outlet port with an airjet issuing slightly upstream thereof and created upon the manual stroke of an air-compression piston, said applicator comprising:

(a.) receiving chamber means wherein a coating fluid is contained, having an inlet port for admitting a quantity of said fluid thereto and an outlet port for discharging a portion thereof;

(b.) a closed compression chamber having sidewalls and opposed end walls, receiving a manually-operated air-compression piston having a stroke length defined generally between said end walls;

(c.) stroke-responsive sealing stem means having a central airway with an airjet orifice at the distal end thereof in registration with said outlet port and communicating at its proximal end with said compression chamber, said stem means being reciprocable in response to the location of said air-compression piston along the stroke length thereof from a biased sealing position in engagement with said outlet port to a spray discharge position, wherein said stem is retracted and said airjet orifice is disposed within said receiving chamber slightly upstream of said outlet port;

(d.) spray control means for reciprocating said stem means in response to the location of said air-compression piston along said stroke length, said spray control means first retracting said stem means to said spray discharge position and then returning said stem means to said sealing position intermediate the length of said stroke, whereby said stem means is in said sealing position at the beginning and end of each stroke of said air-compression piston, said spray control means including a spray control piston means in operative engagement with said stem means, whereby reciprocation of said control piston within said control chamber causes reciprocation of said stem means, and a spray control airway providing communication between said control chamber and said compression chamber through a spray control port located in said sidewall of said compression chamber at a preselected distance along said stroke length corresponding to the stroke-responsive return of said stem means near the end of said stroke; wherein depression of said air-compression piston creates a pressure head within said control chamber having a force in excess of the biasing force on said stem means thereby reciprocating said stem means to said spray discharge position and further wherein continued depression of said air-compression piston beyond said spray control port permits venting of said pressure head and return of said stem means to said sealing position prior to the end of said stroke;

(e.) spray adjustment means for controlling discharge of coating fluid from said outlet port, comprising stem retraction control means including a stop ring in adjustable, cooperative engagement with said stem means within said control chamber for regulating the depth of retraction of said stem means and lever means extending outwardly from said stop ring for positioning said stop ring at a preselected location within said control chamber.

* * * * *